United States Patent [19]

Lisiecki

[11] Patent Number: 4,702,407

[45] Date of Patent: Oct. 27, 1987

[54] FLAT TOP CONTAINER AND BLANK FOR CONSTRUCTING SAME

[75] Inventor: Robert E. Lisiecki, West Bloomfield, Mich.

[73] Assignee: Ex-Cell-O Corporation, Troy, Mich.

[21] Appl. No.: 868,463

[22] Filed: May 30, 1986

[51] Int. Cl.[4] ..... B65D 5/40

[52] U.S. Cl. ..... 206/624; 229/3.5 MF; 229/3.1; 229/137; 229/132; 206/628

[58] Field of Search ..... 229/3.1, 3.5 MF, 905, 229/137, 17 R, 48 T, 48 SC; 206/601, 604, 620, 627, 628, 630, 634

[56] References Cited

U.S. PATENT DOCUMENTS

| | | | |
|---|---|---|---|
| 2,294,964 | 9/1942 | Davidson | 206/628 |
| 2,461,251 | 2/1949 | Ball et al. | 229/137 |
| 2,758,775 | 8/1956 | Moore | 206/628 |
| 3,097,785 | 7/1963 | Meyers | 206/628 |
| 4,359,495 | 11/1982 | Schroeder et al. | 229/3.5 MF |
| 4,397,415 | 8/1983 | Lisiecki | 229/905 |

*Primary Examiner*—Willis Little

*Attorney, Agent, or Firm*—John P. Moran

[57] ABSTRACT

A flat top, thermoplastic coated, paperboard container having weakened lines formed thereon such that the top may be fully opened by breaking through a weakened line at the front and progressively breaking the weakened lines along the sides upon peeling back the cover panel, to provide access to the contents. Provisions are included for covering the weakened lines on the inside of the container to prevent leakage.

14 Claims, 12 Drawing Figures

FLAT TOP CONTAINER AND BLANK FOR CONSTRUCTING SAME

This invention relates generally to thermoplastic coated paperboard containers and, more particularly, to a blank and a container including a top end closure of an improved construction.

BACKGROUND ART

Containers for beverages such as milk, cream, other dairy products, juices, and the like, are conventionally constructed from the thermoplastic coated paperboard. Typically, these containers include a top end closure with a folded roof structure adaptable to providing a readily available pouring spout when the contents of the container are to be dispensed.

Coated paperboard blanks for constructing such a container are made on converting machines similar to those disclosed by Monroe et al U.S. Pat. No. 2,682,208 and Earp U.S. Pat. No. 3,731,600. After construction, the blanks are processed by forming, filling and sealing machines, such as those disclosed by Monroe et al U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the type referred to above and shown and described in Egleston et al U.S. Pat. No. 3,270,940, or Lisiecki U.S. Pat. No. 4,422,570.

While this type of container has been generally satisfactory for liquid products, it is desirable to utilize a similar square or rectangular thermoplastic coated paperboard container for frozen juices with a modified top closure arrangement which is adaptable to being fully opened, in lieu of using a conventional cylindrical paperboard container with a removable metal or solid plastic top cover. Such a modified top closure arrangement is desirable also for containing and providing access to "spoonable" products, such as yogurt and puddings. One example of a satisfactory top closure of a substantially fully openable type is shown and described in Lisiecki U.S. Pat. No. 4,397,415.

DISCLOSURE OF INVENTION

A general object of the invention is to provide a thermoplastic coated paperboard container including improved top closure means for providing the above mentioned desirable fully openable feature for particular products.

Another object of the invention is to provide an improved thermoplastic coated paperboard container suitable for being filled with a juice concentrate and then frozen, or with foodstuffs of a somewhat solid consistency.

A further object of the invention is to provide a square or rectangular paperboard container including an improved, conveniently fully openable flat top closure arrangement.

A still further object of the invention is to provide a flat top container having a lift flap and a cover panel having a perforated portion covered with a foil patch, a thermo-plastic film, or a thermoplastic hot melt.

Still another object of the invention is to provide alternate embodiments of a flat top container wherein the cover panel may be one of a full panel top for maximum "billboard", or overlapping panel segments which may be converted with minimal scrap.

Other objects and advantages of the invention will become more apparent when reference is made to the following drawings and related description.

BEST MODE OF CARRYING OUT THE INVENTION

Figure 1:
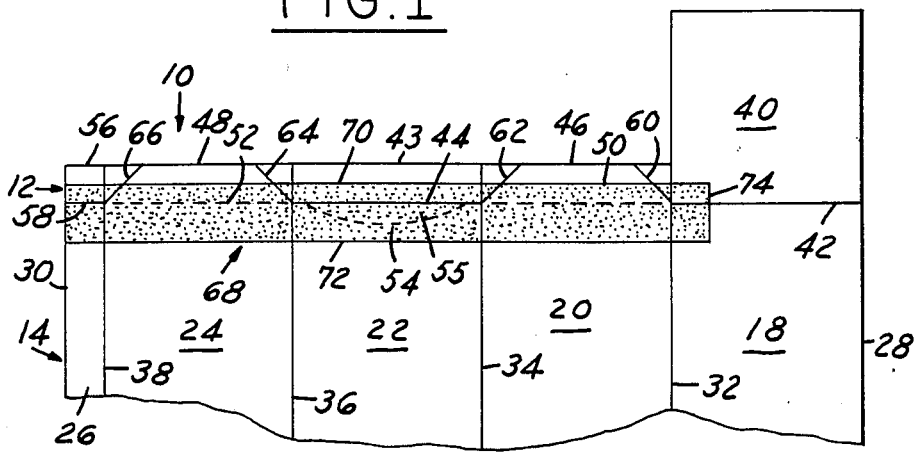
FIG. 1 is a fragmentary layout view of the inside surface of a coated paperboard container blank used to construct a container having a top end closure in accordance with the present invention.

Referring now to the drawings in greater detail, FIG. 1 illustrates a container blank 10 formed in accordance with the principles of the present invention. The container blank 10 is generally divided into three sections including a top end closure 12, a body portion 14, and a conventional flat bottom end closure (not shown). The latter may be any suitable end closure arrangement and is not a part of this invention.

The body portion 14 comprises a plurality of integrally connected body panels, namely, a back panel 18, a side panel 20, a front panel 22 and a side panel 24, and a side seam flap or narrow fifth panel 26 formed adjacent the panel 24. The container blank 10 is defined on its longitudinal sides by edges 28 and 30. The body panels 18, 20, 22 and 24, and the side seam flap 26, are defined by vertical score lines 32, 34, 36 and 38. It should be apparent that the body panels may be equal in width and hence, adaptable to forming a square cross-section container, or may be formed such that one pair of alternate body panels is wider than the other pair and, hence, adaptable to forming a rectangular cross-section container.

The top end closure 12 comprises a cover panel 40 connected by a score line 42 to the back panel 18, and front edge panels 43 connected by a score line 44 to the top of the front body panel 22. Side edge panels 46 and 48 are connected by perforated lines 50 and 52, respectively, to the tops of the side panels 20 and 24. An arcuate shaped perforated line 54 is formed in the front panel 22, arcing from points adjacent the respective ends of the score line 44 to form a segment 55. An edge panel 56 is connected by a score line 58 to the top of the side seam flap 26.

Diagonal score lines 60 and 62 are formed on the edge panel 46, extending from the intersections of the score lines 32/42 and 34/44, respectively. Diagonal score lines 64 and 66 are formed on the edge panel 48, extending from the intersections of the score lines 36/44 and 38/58, respectively.

A layer 68 of a suitable material, such as a thermoplastic hot melt, or a strip of either aluminum foil or thermoplastic film, is secured to all the inside surfaces adjacent the perforated lines 50,52 and 54. Specifically, the top edge 70 of the layer or strip 68 extends from the edge 30 across the panels 56, 48, 43 and 46 at approximately the half heights thereof, and onto the cover panel 40 for a distance approximately the width of the panel 56.

The bottom edge 72 of the layer or strip 68 extends from the edge 30 across the panels 26, 24, 22 and 20 on a line below the bottom of the arcuate perforated line 54 an amount approximately equal to the height of the edge 70 above the score line 44. The edge 72 continues onto the front panel 18 the same distance as the top edge 70. The end of the layer or strip 68 is defined by an edge 74 across the score line 42.

Figure 2:
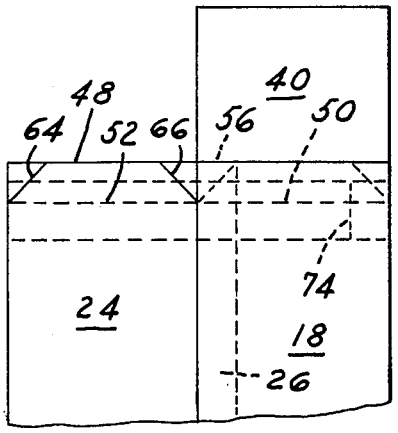
FIG. 2 is a fragmentary layout view of the outside surface of a blank after it is side seamed from the blank illustrated in FIG. 1.

The container blank 10 illustrated in FIG. 1 is first formed into a side seam blank as shown in FIG. 2 by rotating the body panel 24 and the side seam flap 26 as a unit about the vertical score line 36, and having the inside surfaces of the body panel 24 come into contact with the inside surface of the body panel 22, with the vertical score line 38 positioned next to the vertical score line 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the portion adjacent the edge 28 comes into contact with the outside surface of the side seam flap 26, and the edge 28 is positioned parallel and aligned with the vertical score line 38. The various members of a bottom end closure will make similar movements. Insofar as the top end closure 12 is concerned, the edge panel 48 overlies the edge panel 43, the edge panel 56 overlies a portion of the edge panel 46, and the cover panel 40 overlies the edge panels 46 and 56. The container blank 10 is then sealed where the inside areas of the body panel 18 and cover panel 40 come into contact with the outside surfaces of the side seam flap 26 and the edge panel 56.

In the FIG. 1 structure, if desired, in the formation of the side seam blank the side seam panel 26 could be sealed to the outside surface of the adjacent back panel 18, rather than to the inner surface thereof as described above.

Inasmuch as the eventual top closure arrangement of the invention is a non-gable, flat top configuration, it has been proven to be more compatible with existing forming, filling and sealing machines to form such top closure first. Then, after filling the container through the open bottom end, the panels associated therewith are closed and sealed in a manner hertofore used for a conventional top closure arrangment.

Figure 3:
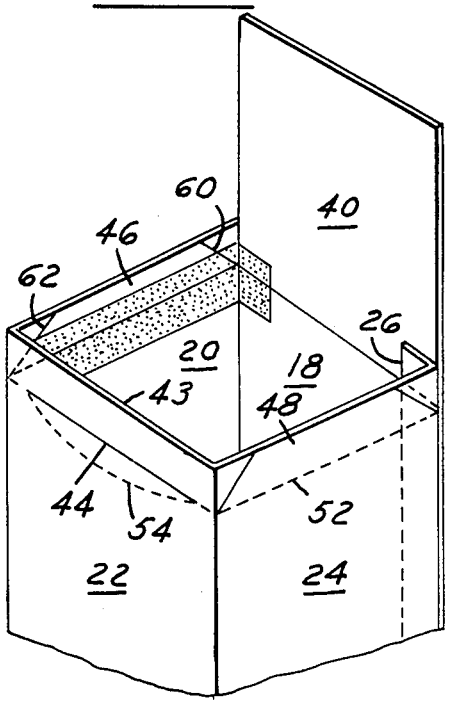
FIGS. 3 and 4 are enlarged fragmentary perspective views illustrating sequentially the steps involved in forming the flat top end closure.

Accordingly, after the side seam blank is opened up into a squared condition, as shown in FIG. 3, the various parts of the eventual top end closure 12 are folded on the various score lines and perforated lines in the following manner so as to form the top end structure. The edge panels 46 and 48 are forced inwardly about the respective perforated lines 50 and 52, after which the front edge panel 43 is urged inwardly about the score line 44, followed by the bending of the cover panel 40 about the score line 42.

Figure 4:
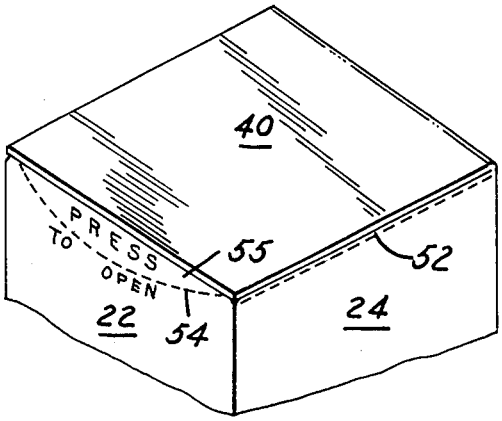

The sealing of the interrelated elements of the top closure 12 is then accomplished by conventional means, such as a sonic or high frequency vibration sealing means. The sealing of the various top end closure elements may also be accomplished by other means, such as gas heat, if desired. FIG. 4 illustrates the top end closure 12 structure once the sealing thereof has been effected.

Figure 5:
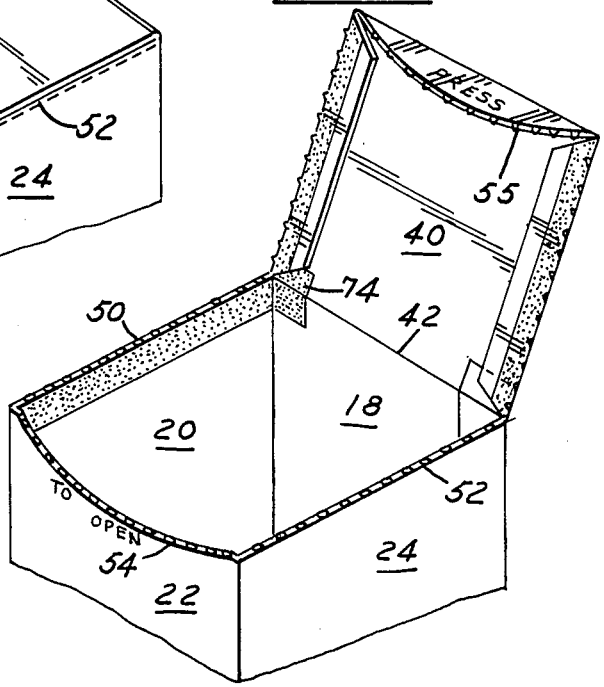
FIG. 5 is a fragmentary perspective view showing the container of FIG. 4 after the top closure has been sealed closed and the opened.

In opening the carton, the arcuate segment 55 between the perforated line 54 and the score line 44 is pressed inwardly, breaking the perforated line 54 and bending the segment 55 about the score line 44. As the segment 55 and the cover panel 40 are raised further, the edge panels 46 and 48 are pulled away from the side panels 20 and 24, breaking the perforated lines 50 and 52 and providing a completely open top as shown in FIG. 5, permitting access to the contents of the container.

Figure 6:
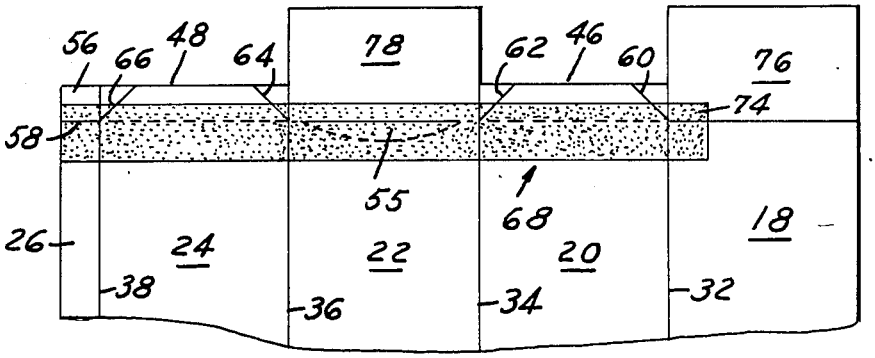
FIG. 6 is a fragmentary layout view of the inside surface of an alternate embodiment blank from which a container embodying the invention may be erected.
Figure 7:
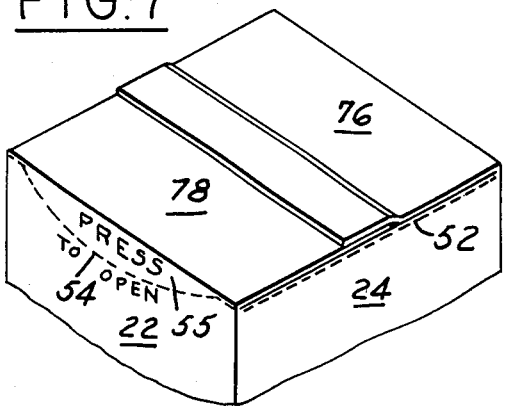
FIGS. 7 and 8 are views of the alternate embodiment comparable to the FIGS. 4 and 5 of the preferred embodiment.
Figure 8:
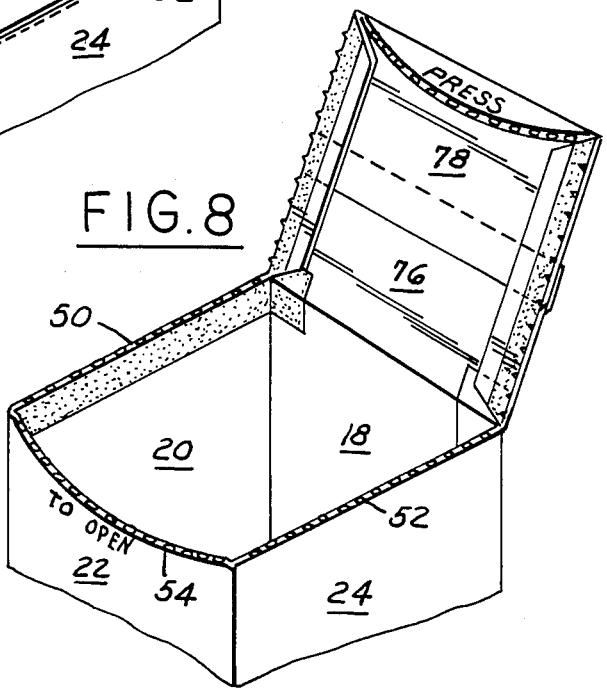

Referring now to FIGS. 6–8, there is illustrated an alternate blank embodiment wherein cover panels 76 and 78 of equal height replace the cover and front edge panels 40 and 43 of the FIG. 1 structure, resulting in an overlapped end closure as shown in FIG. 7. This embodiment opens the same as the FIG. 5 arrangement, as illustrated in FIG. 8.

FIG. 9–12 illustrate still another embodiment, wherein the arcuate perforated line 54 and diagonal score lines 62 and 64 of FIGS. 1 and 6 have been eliminated, and a lift tab 80, cut edges 82 and 84, and a perforated line 86 have been added. The lift tab 80 includes an inner portion 88 and an outer portion 90 separated by a score line 92.

Figure 10:
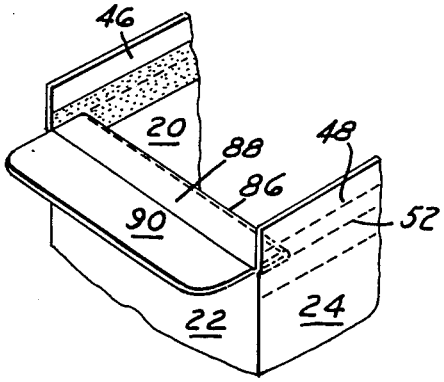
Figure 11:
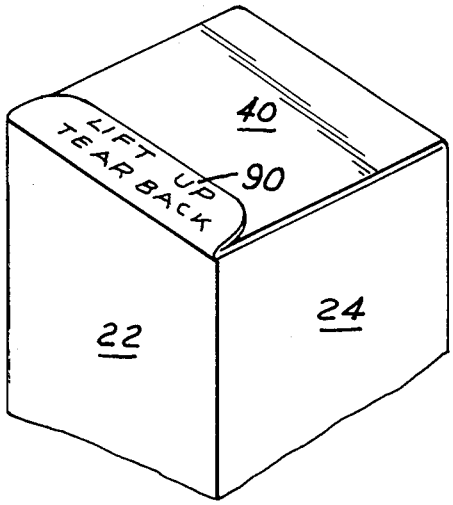

The top end structure for this embodiment is formed by first pivoting the front edge panel 43 inwardly about the score line 44 between the extended edge panels 46 and 48 and the lift tab 80 outwardly about perforated line 86 (FIG. 10). This is made possible by virtue of the cute edge 82 between the edge panels 46 and 42, and the cut edge 84 between the edge panels 46 and 48. Thereafter, once the side edge panels 46 and 48 are bent inwardly about the respective perforated lines 50 and 52, and the cover panel 40 is flattened about the score line 42, the outer portion 90 of the lift tab 80 is folded onto the cover panel 40 about the score line 92 and tack welded thereon (FIG. 11).

Figure 12:
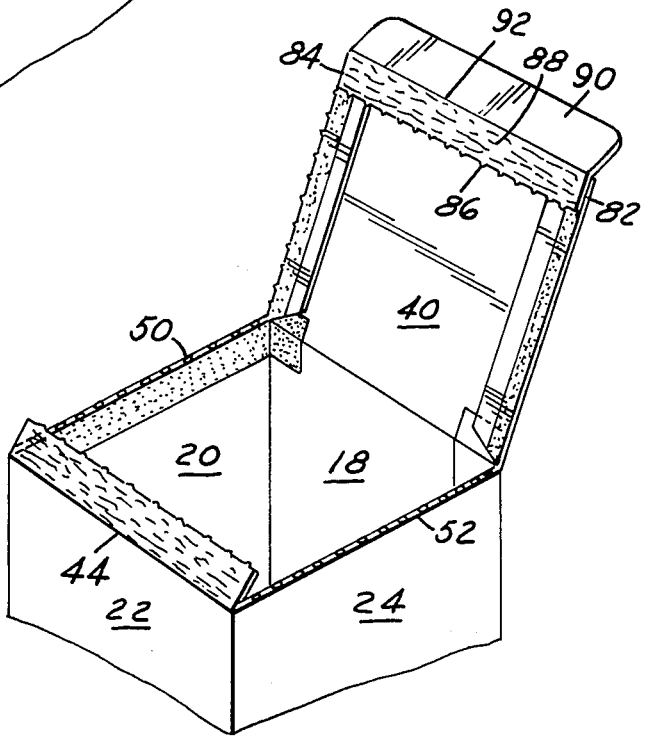

When opening, the outer tab portion 90 is lifted and the cover panel 40 is torn back, separating the perforated lines 86, 50 and 52 to fully expose the contents of the container as shown in FIG. 12.

A still further embodiment is illustrated in FIGS. 13–18. This embodiment is somewhat similar to the FIGS. 6–8 arrangement, but the additional provisions for eliminating raw edges in the top closure being exposed to the contents of the sealed container. This is accomplished by substituting panels 94, 96 and 98 for the panels 46, 48 and 78, respectively, of FIG. 6. The panel 94 includes a substantially centrally located horizontal score line 100, with diverging score lines 102 and 104 extending from one end of the score line 100 to substantially the corners of the panel 94 adjacent a full area cover panel 106 comparable to the cover panel 40 of FIG. 1. The score lines 102 and 104 form a substantially triangular panel 107 with the score line 32. Diverging score lines 108 and 110 extend from the other end of the score line 100 to substantially the corners of the panel 94 adjacent the panel 98, forming a substantially triangular panel 111 with the score line 34. Vertical score lines 112 and 114 extend from the respective ends of the score line 100 upwardly in FIG. 13 to the free edge of the panel 94, forming triangular segments 113 and 115 with the respective score lines 104 and 110 and the free edges of the panel 94.

The panel 96 is comparable to the panel 94 and includes a substantially centrally located horizontal score line 116, with diverging score lines 118 and 120 extending from one end of the score line 116 of substantially the corners of the panel 96 adjacent an edge panel 122 connected by the score line 58 to the side seam flap 26. The score lines 118 and 120 form a substantially triangular panel 123 with the score line 38. Diverging score lines 124 and 126 extend from the other end of the score line 116 to substantially the corners of the panel 96 adjacent the panel 98, forming a substantially triangular panel 127 with the score line 36. Vertical score lines 128 and 130 extend from the respective ends of the score line 116 upwardly in FIG. 13 to the free edge of the panel 96, forming triangular segments 129 and 131 with the respective score lines 120 and 126 and the free edges of the panel 96.

Figure 9:
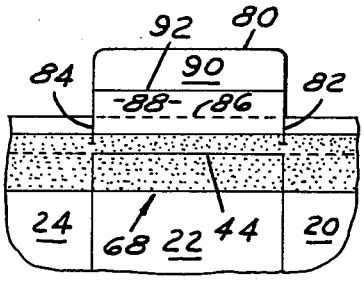
FIG. 9–12 are views of still another embodiment of the invention.

The panel 98 includes segments 132, 134 and 136. The segments 132 and 134 are separated by a score line 138 and substantially equal to each other in height, and of substantially the same height as the panels 94 and 96, the score line 138 being aligned with the free edges of the panels 94 and 96. The segment 136 is separated from the segment 134 by a score line 140 and serves as a lift tab, as will be explained. The same layer 68 as shown in FIGS. 1, 6 and 9 is secured to all the inside surfaces adjacent the perforated lines 50, 52 and 54.

Figure 13:
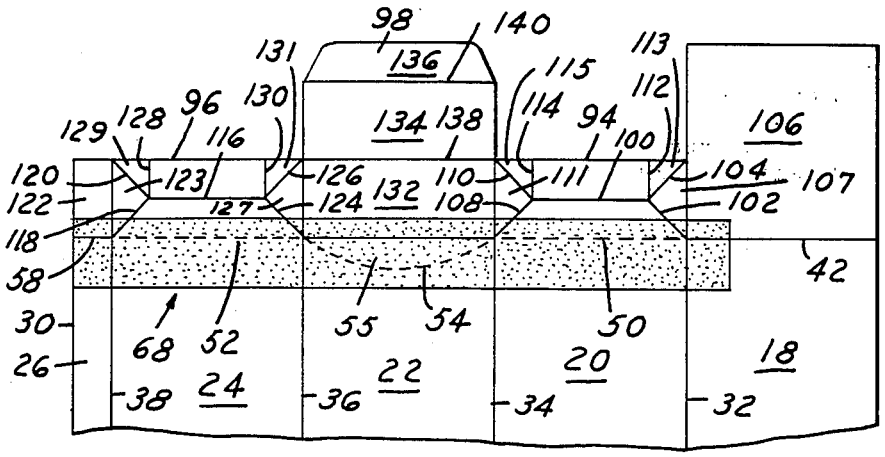
Figure 14:
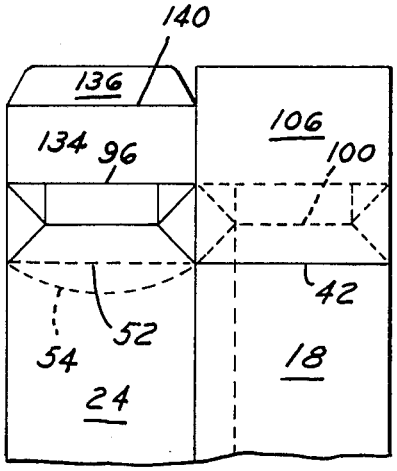
Figure 15:
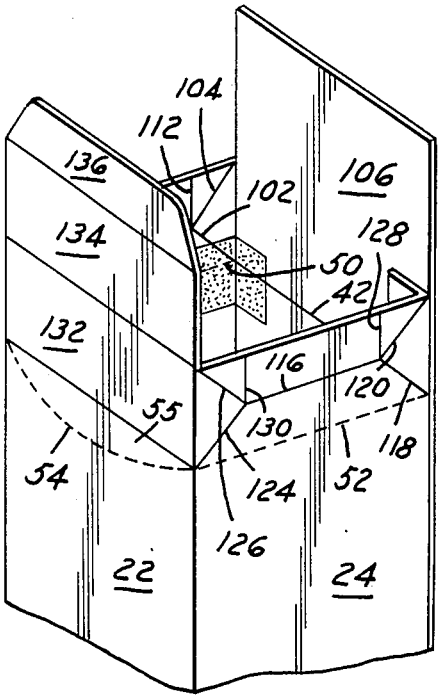
Figure 16:
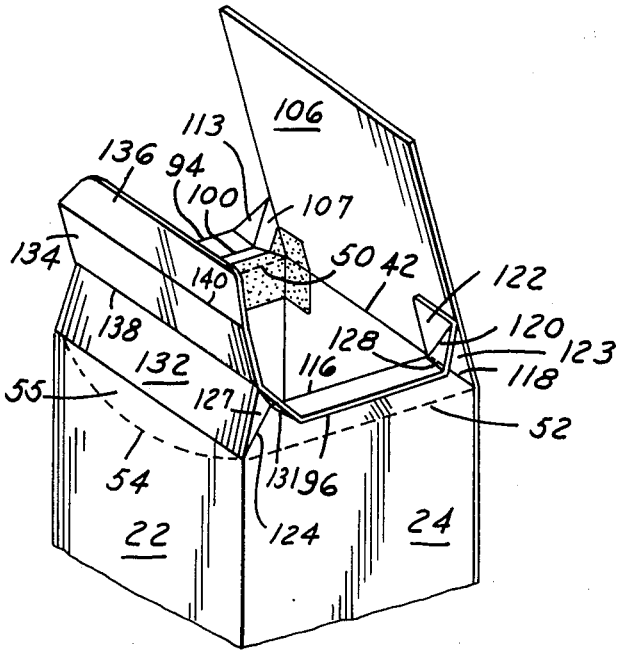

The container blank illustrated in FIG. 13 is first formed into a side seam blank as shown in FIG. 14, as described above relative to FIG. 2, and then opened up into a squared condition, as shown in FIG. 15. The various parts of the eventual top end closure are folded on the various score lines and perforated lines in the following manner. In effect, the score lines 100, 116 and 138 are pushed inwardly, collapsing the segments above and below the respective score lines, as shown in FIG. 16. Specifically, the outer surfaces of the upper halves of the panels 94 and 96 progressively approach the respective outer surfaces of the lower halves, and the outer surface of the upper segment 134 approaches the outer surface of the lower segment 132. Concurrently, the triangular segments 113, 115, 129 and 131 approach the upper halves of the respective triangular panels 107, 111, 123 and 127.

Figure 17:
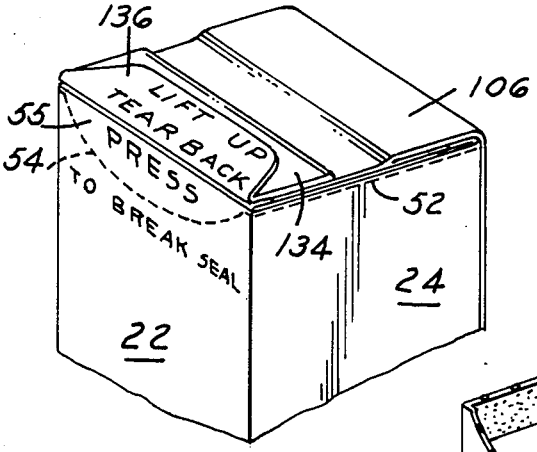

The lift tab 136 is bent around the score line 140 such that its inner surface approaches the inner surface of the segment 134 but, as shown in FIG. 17, the free edge portion of the cover panel 106 is caused to be confined and sealed between the adjacent surfaces of the segment 134 and the lift tab 136.

Due to the conventional thermoplastic coating on all inside and outside surfaces of the blanks shown in FIGS. 1, 6, 9 and 13, all contacting surfaces of each of the closed containers shown in FIGS. 4, 7, 11 and 17 are sealed to each other under heat and pressure or vibration in the end sealing operation.

Figure 18:
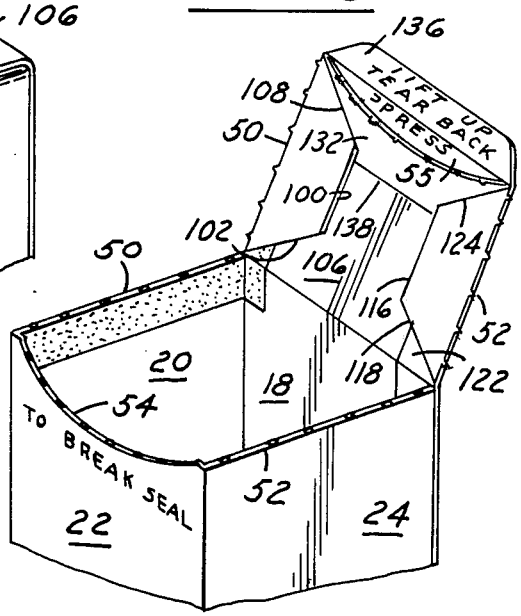

Referring now to FIG. 18, in a manner similar to that involved for FIGS. 5 and 8, manually pressing in the panel segment 55 breaks the weakened line 54, after which lifting is made easy by the tab 136, serving to break the weakened lines 50 and 52 to thereby expose a fully opened top, providing complete access to the contents of the container.

It should be realized that a panel somewhat similar to the panel 98 could be used on the blank of FIG. 1, in lieu of the panel 43, and visa versa, if desired.

INDUSTRIAL APPLICABILITY

It should be apparent that the invention provides a novel and efficient thermoplastic coated paperboard carton which is ideally suited for being filled with a frozen concentrate, such as orange juice, or with a spoonable product, such as yogurt and puddings, for example, and sealed for distribution through the marketing system, and capable of being readily and easily opened by the consumer.

It is believed to be important to note that if the perforated lines 50, 52 and 54 were formed first on the central paperboard layer, and the conventional thermoplastic coating, such as polyethylene, added thereafter, it would be possible to omit the layer 68 from the blanks of FIGS. 1, 6, 9 and 13. Furthermore, in lieu of the perforated lines 50, 52 and 54, a partial continual cut made on the outside surface through the outer half of the paperboard thickness could be utilized, also permitting the omission of the inner extra layer 68 described above.

While four embodiments of the invention have been shown and described, other modifications thereof are possible within the scope of the following claims.

The embodiments of the invention in which an exclusive property or privilege is claimed are defined as follows:

1. A thermoplastic coated container comprising:
(a) body panels including front and back panels and a pair of side panels;
(b) a pair of side fold-in edge panels integrally connected by first and second horizontal weakened lines to the top end of said pair of side panels and folded on said first and second horizontal weakened lines inwardly toward one another;
(c) a front panel integrally connected by a first horizontal score line to the top end of said front panel;
(d) a cover panel integrally connected by a second horizontal score line to said back body panel and folded on said second horizontal score line onto and secured to said side fold-in edge panels and to said front;
(e) a third weakened line operatively connected to said front panel and adapted to being manually broken to permit further breaking of said first and second weakened lines by the manual lifting of said cover panel; and
(f) a layer of one of aluminum foil, thermoplastic film and hot melt secured to the inside surfaces of the container covering the first and second horizontal weakened lines and the first horizontal score line and to segments of the immediately adjacent panel surfaces.

2. The container described in claim 1, wherein said third weakened line is an arcuate ine extending downwardly from the first horizontal score line, being formed in said front panel and adapted to being pushed inwardly to be broken.

3. The container described in claim 2, wherein said layer also covers said third weakened line and is secured to segments of the immediately adjacent panel surfaces.

4. The container described in claim 1, and a lift tab secured by said front panel, and cut edges separating said respective side fold-in edge panels from said front panel.

5. The container described in claim 4, wherein said layer does not cover said third weakened line.

6. The container described in claim 5, wherein said lift tab includes an inner segment and an other segment, said inner and outer segments being interconnected by a score line formed across the width of said lift tab at a distance away from said third weakened line equal to the height of said front panel, said inner segment being secured between said front panel and said cover panel, and said outer segment being folded about said score line onto said cover panel and adapted to being lifted so as to separate said inner segment from said front panel, break said third weakened line, and progressively break said first and second weakened lines.

7. The container described in claim 3, and a pair of diagonal score lines formed on each of said side fold-in edge panels at the ends thereof, each said pair of diagonal score lines converging in an upwardly direction and forming corner segments sealed between said fold-in edge panels and said cover panel.

8. The container described in claim 5, and a diagonal score line formed on each of said side fold-in edge panels at the end thereof away from said front edge panel so as to form a corner segment adapted to being sealed between said fold-in edge panel and said cover panel.

9. The container described in claim 7, wherein said corner segments are triangular in shape.

10. The container described in claim 7, wherein said corner segments are trapezoidal in shape.

11. The container described in claim 8, wherein said corner segments are triangular in shape.

12. The container described in claim 8, wherein said corner segments are trapezoidal in shape.

13. The container described in claim 7, and an additional panel segment connected by a horizontal score line to each of said side fold-in edge panels, and a pair of diagonal score lines diverging upwardly from the respective ends of the horizontal score line to substantially the corners of the additional panel segment, and adapted to fold onto said respective side fold-in edge panels, thereby eliminating raw edges along the sides of the inside end closure.

14. The container described in claim 13, wherein said front panel consists of three segments, two of which are substantially equal in height and equal to the overall height of the side fold-in edge panel and the additional panel segment, and are folded inwardly onto each other to thereby eliminate a raw edge along the front of the inside end closure, and the third of which serves as a lift tab being folded onto and sealed to the outer surface of the free edge portion of said cover panel.

* * * * *